US007574782B2

(12) United States Patent
Ackerman

(10) Patent No.: US 7,574,782 B2
(45) Date of Patent: Aug. 18, 2009

(54) APPARATUS AND METHOD OF OPERATIVELY RETAINING AN ACTUATING MEMBER ON AN ELONGATE CLOSURE MECHANISM

(75) Inventor: Bryan L. Ackerman, Freeland, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 574 days.

(21) Appl. No.: 11/440,856

(22) Filed: May 25, 2006

(65) Prior Publication Data

US 2006/0265844 A1 Nov. 30, 2006

Related U.S. Application Data

(60) Provisional application No. 60/684,941, filed on May 26, 2005.

(51) Int. Cl.
*A44B 19/16* (2006.01)

(52) U.S. Cl. ..... 24/400

(58) Field of Classification Search ..... 24/30.5 R, 24/399, 400; 383/61.3, 64
See application file for complete search history.

(56) References Cited

U.S. PATENT DOCUMENTS

| | | | |
|---|---|---|---|
| 1,666,110 | A | 4/1928 | Statham |
| 2,867,877 | A | 1/1959 | Staller et al. |
| 2,875,491 | A | 3/1959 | Morin |
| 2,929,123 | A | 3/1960 | Schneideman |
| 3,074,137 | A | 1/1963 | Hawley |
| 3,103,049 | A | 9/1963 | Hawley |
| 3,115,689 | A | 12/1963 | Jacobs |
| 3,122,807 | A | 3/1964 | Ausnit |
| 3,173,184 | A | 3/1965 | Ausnit |
| 3,220,076 | A | 11/1965 | Ausnit et al. |
| 3,324,520 | A | 6/1967 | Ausnit |
| 3,426,396 | A | 2/1969 | Laguerre |
| 3,660,875 | A | 5/1972 | Gutman |
| 3,713,923 | A | 1/1973 | LaGuerre |
| 3,806,998 | A | 4/1974 | LaGuerre |
| 3,959,856 | A | 6/1976 | Ausnit |
| 4,513,484 | A | 4/1985 | Iblings |
| 4,541,117 | A | 9/1985 | Ashbeck |
| 4,922,586 | A | 5/1990 | Robson |

(Continued)

FOREIGN PATENT DOCUMENTS

| | | |
|---|---|---|
| EP | 0 051 010 | 5/1982 |

(Continued)

*Primary Examiner*—James R Brittain

(57) ABSTRACT

A pouch includes an elongate closure mechanism having upper and lower pairs of opposing interlocking profiles and a slider for opening and closing the closure mechanism. The slider includes upper closure bars vertically and longitudinally spaced from lower closure bars for occluding the upper and lower opposing interlocking profiles, respectively, and a separator member for separating only the upper opposing interlocking profiles. The lower closure bars are disposed at the opening end, and the upper closure bars are disposed at a closing end of the slider opposite the opening end. A longitudinal retention member extends longitudinally from the separator finger toward the closing end below the upper closure bars, and a lateral retention member extends laterally outwardly from the separator member above the lower closure bars. The longitudinal retention member and the lateral retention member each engages an underside of the upper pair of interlocking profiles to help retain the slider on the closure mechanism.

16 Claims, 4 Drawing Sheets

U.S. PATENT DOCUMENTS

| | | | | |
|---|---|---|---|---|
| 4,944,072 | A | 7/1990 | Robson | |
| 5,007,142 | A | 4/1991 | Herrington | |
| 5,007,143 | A | 4/1991 | Herrington | |
| 5,010,627 | A | 4/1991 | Herrington et al. | |
| 5,020,194 | A | 6/1991 | Herrington et al. | |
| 5,063,644 | A | 11/1991 | Herrington et al. | |
| 5,067,208 | A | 11/1991 | Herrington, Jr. et al. | |
| 5,070,583 | A | 12/1991 | Herrington | |
| 5,283,932 | A | 2/1994 | Richardson et al. | |
| 5,301,394 | A | 4/1994 | Richardson et al. | |
| 5,442,837 | A | 8/1995 | Morgan | |
| 5,442,838 | A | 8/1995 | Richardson et al. | |
| 5,448,808 | A | 9/1995 | Gross | |
| 5,664,299 | A | 9/1997 | Porchia et al. | |
| 5,809,621 | A | 9/1998 | McCree et al. | |
| 5,867,875 | A | 2/1999 | Beck et al. | |
| 5,871,281 | A | 2/1999 | Stolmeier et al. | |
| 5,896,627 | A | 4/1999 | Cappel et al. | |
| 5,947,603 | A | 9/1999 | Tilman | |
| 5,953,796 | A | 9/1999 | McMahon et al. | |
| 5,956,815 | A | 9/1999 | O'Connor et al. | |
| 5,983,466 | A | 11/1999 | Petkovsek | |
| 6,014,795 | A | 1/2000 | McMahon et al. | |
| 6,036,364 | A | 3/2000 | Heuvel | |
| 6,047,450 | A | 4/2000 | Machacek et al. | |
| 6,088,887 | A * | 7/2000 | Bois | 24/399 |
| 6,112,374 | A | 9/2000 | Van Erden | |
| 6,220,754 | B1 | 4/2001 | Stiglic et al. | |
| 6,257,763 | B1 | 7/2001 | Stolmeier et al. | |
| 6,290,391 | B1 | 9/2001 | Buchman | |
| 6,293,701 | B1 | 9/2001 | Tomic | |
| 6,305,844 | B1 | 10/2001 | Bois | |
| 6,361,209 | B1 | 3/2002 | LaRue et al. | |
| 6,439,771 | B1 | 8/2002 | Herrington, Jr. | |
| 6,461,042 | B1 * | 10/2002 | Tomic et al. | 383/64 |
| 6,477,821 | B1 | 11/2002 | Bois | |
| 6,481,890 | B1 | 11/2002 | VandenHeuvel | |
| 6,490,769 | B2 | 12/2002 | Siegel | |
| 6,595,689 | B1 | 7/2003 | Borchardt et al. | |
| 6,609,353 | B1 | 8/2003 | McMahon et al. | |
| 6,609,827 | B2 | 8/2003 | Bois et al. | |
| 6,611,996 | B2 | 9/2003 | Blythe et al. | |
| 6,632,021 | B2 | 10/2003 | Bois et al. | |
| 6,666,580 | B2 | 12/2003 | Bois | |
| 6,698,926 | B2 | 3/2004 | Buchman | |
| 6,733,178 | B2 | 5/2004 | Bois | |
| 6,739,755 | B2 | 5/2004 | Schreiter | |
| 6,755,569 | B2 | 6/2004 | Bois | |
| 6,761,481 | B1 | 7/2004 | Bois | |
| 6,789,947 | B1 | 9/2004 | Kasai | |
| 6,817,763 | B2 | 11/2004 | Tomic | |
| 6,854,887 | B2 | 2/2005 | Anderson | |
| 6,874,205 | B1 | 4/2005 | Savicki | |
| 6,880,972 | B2 | 4/2005 | Plourde | |
| 6,883,210 | B1 | 4/2005 | Savicki | |
| 6,896,409 | B2 | 5/2005 | Plourde et al. | |
| 6,902,321 | B2 | 6/2005 | Bois | |
| 6,915,546 | B2 | 7/2005 | Kasai | |
| 6,951,421 | B2 | 10/2005 | Crunkleton et al. | |
| 6,962,440 | B2 | 11/2005 | Fenzl et al. | |
| 6,996,879 | B1 | 2/2006 | Savicki | |
| 7,017,241 | B2 | 3/2006 | Bentsen | |
| 7,036,987 | B2 | 5/2006 | Crunkleton et al. | |
| 2002/0034342 | A1 | 3/2002 | Bois | |
| 2002/0034344 | A1 | 3/2002 | Bois | |
| 2003/0202718 | A1 | 10/2003 | Tomic | |
| 2003/0217444 | A1 | 11/2003 | Blythe et al. | |
| 2004/0010893 | A1 * | 1/2004 | Kasai | 24/438 |
| 2004/0045138 | A1 * | 3/2004 | Kasai | 24/399 |
| 2004/0161167 | A1 | 8/2004 | Ausnit et al. | |
| 2004/0161173 | A1 | 8/2004 | Linton et al. | |
| 2005/0008267 | A1 | 1/2005 | Linton et al. | |
| 2005/0084183 | A1 | 4/2005 | Ausnit | |
| 2006/0029300 | A1 * | 2/2006 | Yoder | 383/64 |

FOREIGN PATENT DOCUMENTS

| | | |
|---|---|---|
| EP | 0 479 661 | 4/1992 |
| EP | 0 941 937 | 9/1999 |
| FR | 2 636 923 | 3/1990 |
| JP | 06-077518 | 11/1994 |
| JP | 08-214920 | 8/1996 |
| JP | 2000-023716 | 1/2000 |
| JP | 2000-152810 | 6/2000 |
| JP | 2004-161305 | 6/2004 |
| WO | WO 91/13759 | 9/1991 |
| WO | WO 92/17084 | 10/1992 |
| WO | WO 92/17086 | 10/1992 |
| WO | WO 92/19450 | 11/1992 |
| WO | WO 92/20252 | 11/1992 |

* cited by examiner

APPARATUS AND METHOD OF OPERATIVELY RETAINING AN ACTUATING MEMBER ON AN ELONGATE CLOSURE MECHANISM

CROSS REFERENCE TO RELATED APPLICATIONS

This application claims the benefit of U.S. Provisional Patent Application No. 60/684941, filed May 26, 2005, which is incorporated by reference in its entirety herein.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates to a slider for occluding and de-occluding an elongate closure mechanism having spaced apart upper and lower pairs of opposing interlocking profiles.

2. Description of the Background of the Invention

Closure mechanisms that include a slider for occluding and de-occluding one or more pairs of opposing interlocking profiles are known. The slider facilitates relatively easy opening and closing of the interlocking profiles. A difficulty with such closure mechanisms, however, is preventing leakage around a separating member when the slider is disposed in a fully closed position on the interlocking profiles.

In one instance, a slider includes a separator finger that extends only between an upper pair of opposing interlocking profiles so that the slider does not separate a lower pair of opposing interlocking profiles. When slid along the closure mechanism in an opening direction, the slider only opens the upper pair of opposing interlocking profiles. A user then manually opens the lower pair of opposing interlocking profiles, such as by pulling the profiles apart. When slid along the closure mechanism in a closing direction, the slider has projections that are adapted to cause the upper and lower pairs of opposing interlocking profiles to move together and engage mutually.

In another instance, a slider for a closure mechanism having upper and lower pairs of opposing interlocking profiles has an opening plow that separates the upper and lower pairs of interlocking profiles when slid in an opening direction along the closure mechanism. The plow is a vertical member depending from a top wall of the slider and a horizontal member extending laterally from a lower end of the vertical member outwardly toward left and right sidewalls of the slider between the upper and lower interlocking profiles. The horizontal member presses against a backing member extending between the upper and lower interlocking profiles to separate the interlocking profiles without having the vertical member engage the interlocking profiles.

SUMMARY OF THE INVENTION

In one aspect of the invention, a slider for operatively engaging an elongate closure mechanism having opposing pairs of upper and lower interlocking profiles includes a first sidewall opposing a second sidewall, the first and second sidewalls depending from a top wall and defining a channel therebetween for accepting the closure mechanism therein. A first closure bar is disposed on the first sidewall proximate an opening end of the channel, and a second closure bar is disposed on the first sidewall spaced from the first closure bar toward a closing end of the channel opposite the opening end. The first closure bar is vertically aligned with and adapted to close the lower interlocking profiles, and the second closure bar is disposed to close the upper interlocking profiles. A separator member extending into the channel from the top wall proximate the opening end is spaced between the first and second sidewalls. The separator member is disposed to separate the upper interlocking profiles In another aspect of the invention, a method of operatively retaining a slider on a resealable closure mechanism having opposing elongate first and second interlocking profiles includes the step of separating the first interlocking profile from the second interlocking profile using a separator member carried by the slider at a first longitudinal position along the resealable mechanism. The method further includes the step of pressing the first and second interlocking profiles together at a second longitudinal position adjacent to the first longitudinal position simultaneous with the separating step. Still further, the method includes the step of engaging a retention member against an underside of at least one of the first and second interlocking profiles at the second longitudinal position to prevent the slider from disengaging from the resealable closure mechanism.

In a further aspect of the invention, a closure mechanism includes an elongate closure profile and an actuating member slidably disposed on the elongate closure profile. The elongate closure profile includes a first interlocking member disposed on a first backing member and a second interlocking member disposed on the first backing member and spaced below the first interlocking member. The elongate closure profile also includes a third interlocking member disposed on a second backing member and a fourth interlocking member disposed on the second backing member and spaced below the third interlocking member. The actuating member is adapted to occlude and de-occlude at least the first interlocking member and the third interlocking member. The actuating member includes a body defining a channel extending between an opening end and a closing end opposite the opening end, a separator member, a first retention member, and a second retention member. The channel accepts the elongate closure profile therein. The separator member extends into the channel between the first interlocking member and the third interlocking member. The first retention member is carried by the separator member and projects laterally directly under a de-occluded portion of the first interlocking member and the second interlocking member. The second retention member is carried by the separator member and projects toward the closing end directly under an occluded portion of the first interlocking member and the third interlocking member. The actuating member also includes a first pair of opposing closing members aligned with the first interlocking member and the third interlocking member, and a second pair of opposing closing members aligned with the second interlocking member and the fourth interlocking member. The first pair of opposing closing members is disposed directly above a portion of the second retention member and urges the first interlocking member into interlocking relation with the third interlocking member therebetween. The second pair of opposing closing members urges the second interlocking member into interlocking relation with the fourth interlocking member therebetween. The separator member is disposed between the first pair of opposing closing members and an opening end of the second pair of opposing closing members.

Other aspects of the present invention will become apparent upon consideration of the following detailed description in which:

DETAILED DESCRIPTION

Figure 1:
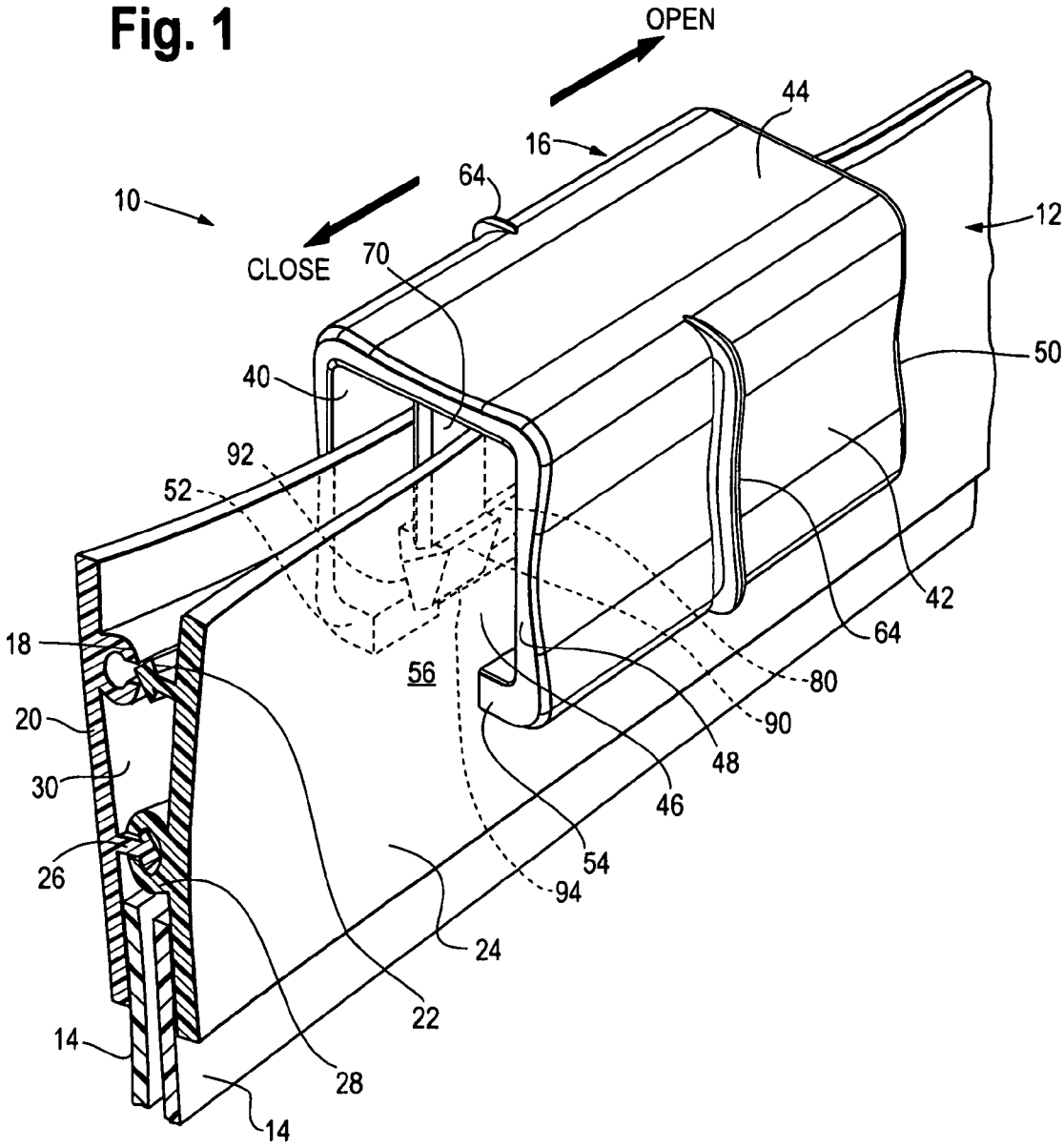
FIG. 1 is a partial isometric view in cutaway cross section of a pouch including a slider operationally disposed on an elongate closure mechanism.
Figure 2:
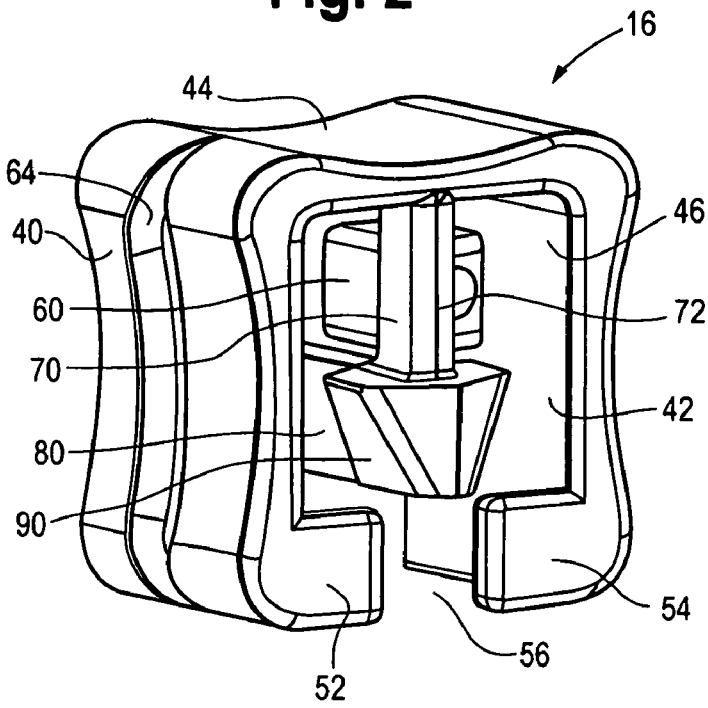
FIGS. 2 and 3 are trimetric views of the slider from different angles.
Figure 3:
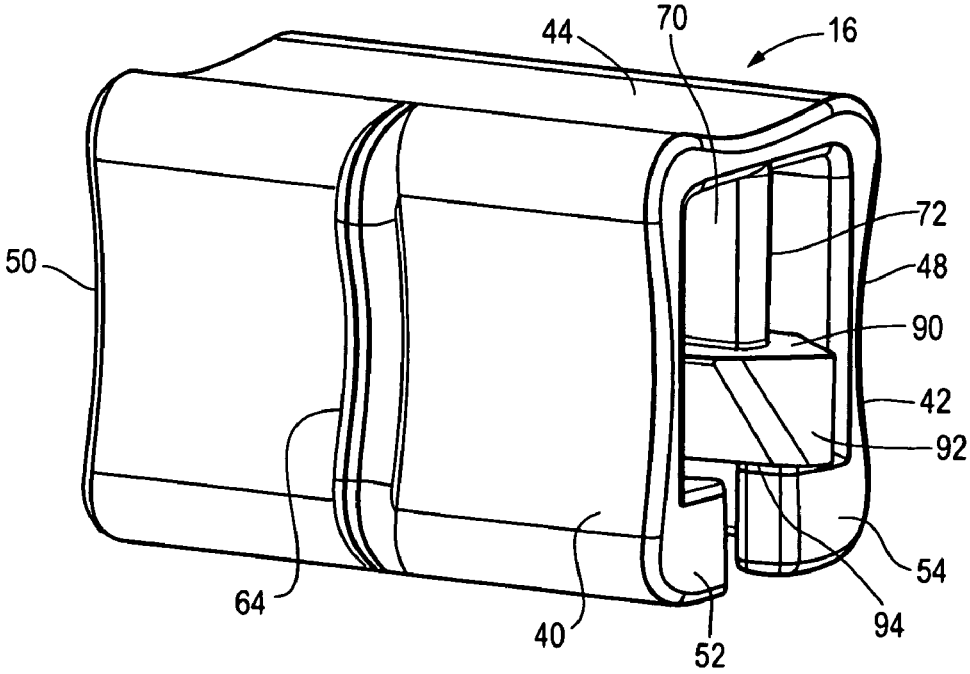
Figure 4:
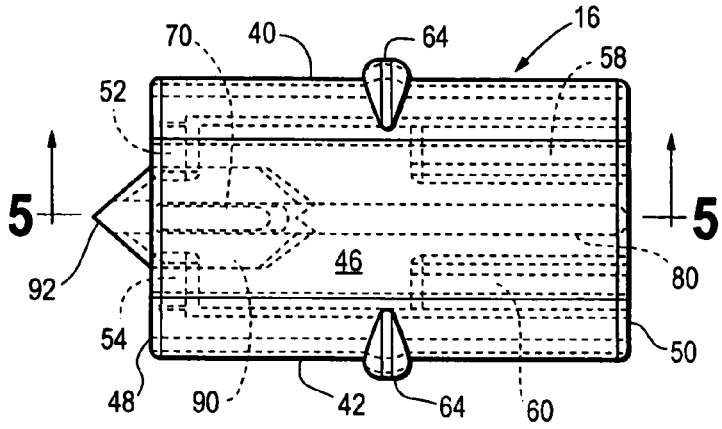
FIG. 4 is a plan view of the slider with hidden portions shown in dashed lines.
Figure 5:
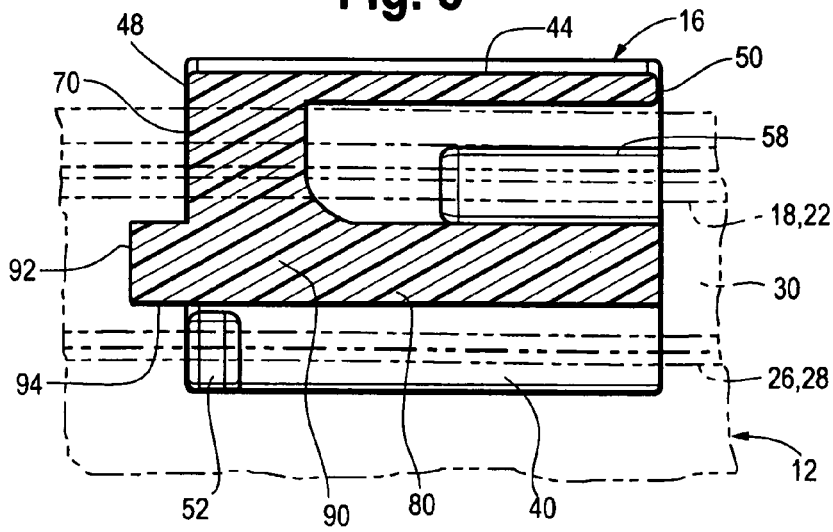
FIG. 5 is a cross-sectional view of the slider along the line 5-5 in FIG. 4 with portions of the closure mechanism shown in dashed lines for explanatory purposes.
Figure 6:
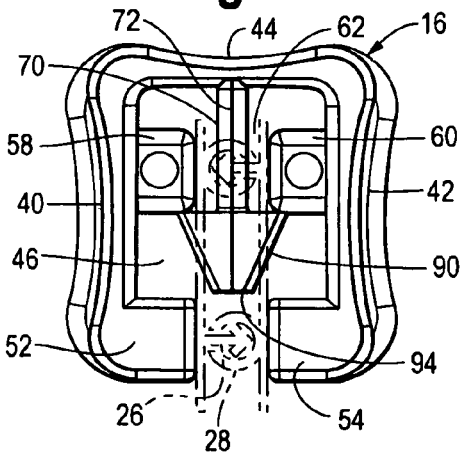
FIG. 6 is an elevational view of an opening end of the slider with portions of the closure mechanism shown diagrammatically in dashed lines for explanatory purposes.

With reference to FIGS. 1-6, a pouch 10 includes a longitudinally elongate closure mechanism 12 disposed along top edges of opposing pouch sidewalls 14 and a slider 16 for partially opening and fully closing the closure mechanism. The closure mechanism 12 includes spaced apart upper and lower pairs of opposing interlocking members. The upper pair of opposing interlocking members includes an upper interlocking profile 18 disposed on a backing member 20 and an upper interlocking profile 22 disposed on a backing member 24. The lower pair of opposing interlocking members includes a lower interlocking profile 26 disposed on the backing member 20 and a lower interlocking profile 28 disposed on the backing member 24. The upper interlocking profiles 18, 22 are spaced vertically from the lower interlocking profiles 26, 28 forming a space 30 therebetween. The closure mechanism 12 in one embodiment is post applied to the sidewalls 14, and in another embodiment, the closure mechanism is formed integrally with the sidewalls. The slider 16, when operationally disposed on the closure mechanism 12, closes, or occludes, both the upper interlocking profiles 18, 22 and the lower interlocking profiles 26, 28 when slid along the closure mechanism in a first direction, and separates only the upper interlocking profiles 18, 22 when slid along the closure mechanism 12 in a second direction opposite the first direction, leaving the lower interlocking profiles 26, 28 occluded.

The slider 16 includes a left sidewall 40 and a right sidewall 42, both extending vertically downwardly from a top wall 44, and together defining a channel 46 extending between an opening end 48 and a closing end 50 opposite the opening end, which accepts the closure mechanism 12 therein. A lower pair of protrusions, such as a lower closure bar 52 and a lower closure bar 54, extends into the channel 46 from the left sidewall 40 and the right sidewall 42, respectively, at the opening end 48, and defines a gap 56 therebetween, which is sized to accept the lower interlocking profiles 26, 28 therein. The lower closure bars 52, 54 are spaced from the top wall 44 so as to engage and/or occlude the lower interlocking profiles 26 and 28. An upper pair of protrusions, such as an upper closure bar 58 and an upper closure bar 60, extends into the channel 46 from the left sidewall 40 and the right sidewall 42, respectively, proximate the closing end 50, and defines a gap 62 therebetween, which is sized to accept the upper interlocking profiles 18, 22 therein. The upper closure bars 58, 60 are vertically disposed between the top wall 44 and the lower closure bars 52, 54 so as to engage and/or occlude the upper interlocking profiles 18 and 22. Further the lower closure bars 52, 54 are longitudinally spaced from the upper closure bars 58, 60. As shown in dashed lines in FIGS. 5 and 6, when the slider is operationally disposed on the closure mechanism 12, the upper closure bars 58, 60 are vertically aligned with the upper interlocking profiles 18, 22, and the lower closure bars 52, 54 are vertically aligned with the lower interlocking profiles 26, 28. In one embodiment, the lower closure bars 52, 54 occlude only the lower interlocking profiles 26, 28 and the upper closure bars 58, 60 occlude only the upper interlocking profiles 18, 22. Traction members, such as ridges 64, are disposed on an exterior portion of the left sidewall 40 and the right sidewall 42 to provide a gripping surface for a user when sliding the slider 16 along the closure mechanism 12. In another embodiment, at least the upper closure members 58, 60 engage and/or occlude the upper interlocking profiles 18, 22 and the lower interlocking profiles 26, 28 and no traction members 64 are included.

A separator member 70, laterally spaced between the left sidewall 40 and the right sidewall 42, depends vertically downwardly from the top wall 44 into the channel 46 proximate the opening end 48. In one embodiment, the separator member 70 is longitudinally aligned with the lower closure bars 52, 54 and longitudinally spaced from the upper closure bars 58, 60 toward the opening end 48. The separator member 70 extends between the upper interlocking profiles 18, 22 and not between the lower interlocking profiles 52, 54 when the slider is operationally disposed on the closure mechanism 12. The separator member 70 includes a tapered edge 72 at the opening end to gently guide the upper interlocking profiles 18, 22 into the channel 46 without damaging the upper interlocking profiles while closing the closure mechanism 12.

A tail member 80 extends horizontally from the separator member 70 longitudinally along the channel 46 toward the closing end 50. The tail member 80 extends vertically beneath and longitudinally coextensive with the upper closure bars 58, 60 and is spaced laterally between the left sidewall 40 and the right sidewall 42, such that the tail member is disposed in the space 30 between the upper interlocking profiles 18, 22 and the lower interlocking profiles 26, 28 when the slider 16 is operationally disposed on the closure mechanism 12. The tail member 80 engages lower surfaces of the upper interlocking profiles 18, 22 as the upper interlocking profiles are occluded between the upper closure bars 58, 60 to prevent the slider 16 from disengaging from the closure mechanism 12. The tail member 80, in one embodiment, also extends to or beyond the closing end 50 and prevents the slider 16 from sliding off of the closure mechanism 12 when the slider is in the full open position by engaging an end weld (not shown) of the closure mechanism without requiring an end stomp (not shown).

A horizontal member 90, or step, disposed at a bottom end of the separator member 70 projects laterally outwardly therefrom toward the side walls 40 and 42. The horizontal member 90 is vertically spaced from the top wall 44 to be disposed in the space 30 and engaged against the lower sides of the upper interlocking profiles 18 and 22 to help maintain the slider operationally disposed on the closure mechanism 12. The horizontal member 90 in one embodiment also includes a tapered nose portion 92, which extends longitudinally beyond the opening end 48 of the left and right sidewalls 40, 42. The nose portion 92 engages an opposite end weld (not shown) of the closure mechanism 12 before the separator member 70 engages the end weld and thereby prevents the slider 16 from sliding off of the closure mechanism. The horizontal member 90 may also include a tapered lower edge 94 to minimize any opening forces exerted by the horizontal member against the lower interlocking profiles 26, 28.

Figure 7:
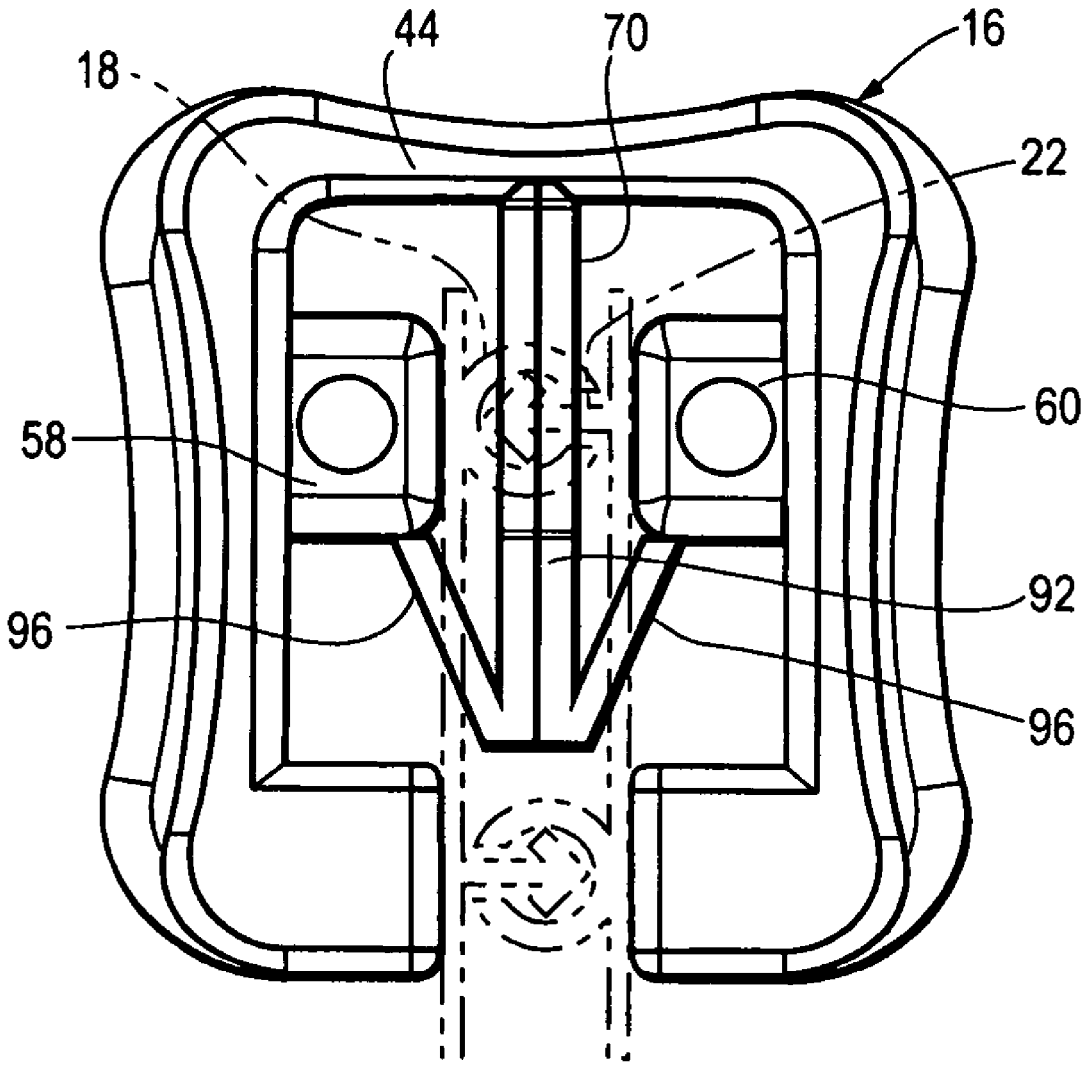
FIG. 7 is an elevational view of an opening end of the slider according to another embodiment of the invention with portions of the closure mechanism shown diagrammatically in dashed lines for explanatory purposes.

In another embodiment shown in FIG. 7, a slider 16 is substantially the same as the slider 16 shown in FIGS. 1-6, except that the horizontal member 90 is replaced with an a hook member 96. The hook member 96 abuttingly engages an underside of the upper interlocking profiles 18, 22 to slidably retain the slider operatively engaged on the closure mechanism 12. The hook member 96 may have different forms, such as, for example, a flange angularly extending from a lower edge 94 of a separator member 70 toward a top wall 44 of the slider 16 and having a terminal end aligned with a lower surface of upper closure bars 58 and 60 as shown in FIG. 7. In another exemplary embodiment (not shown), the hook member 96 is curved upwardly from the lower edge 94 toward the top wall 44. A nose member 92 protruding from the separator member is similar to the nose member 92 shown in FIGS. 2-6.

In use, when the slider 16 is operatively retained on the closure mechanism 12, the separator member 70 separates the upper interlocking profiles 18, 22 at a point proximate the opening end. At the same time, the upper interlocking profiles 18, 22 are pressed together by the upper closure bars 58, 60 at a point proximate the closing end, and the lower interlocking profiles 26, 28 are pressed together by the lower closure bars 52, 54 at a point adjacent to the opening end. In addition, the tail member 80 engages an underside of the upper interlocking profiles 18, 22 at least partly longitudinally aligned with the upper closure bars 58, 60 and the horizontal member 90 engages an underside of the upper interlocking profiles ahead of the upper closure bars to help maintain the slider 16 on the closure mechanism 12. For example, when the slider 16 is tracked along the closure mechanism 12 in a closing direction as indicated in FIG. 1, the lower closure bars 52, 54 occlude the lower interlocking profiles 26, 28 and the upper closure bars 58, 60 occlude the upper interlocking profiles 18, 22. The horizontal member 90 and the tail member 80 prevent the slider from disengaging with the closure mechanism 12 by engaging the undersides of the respective upper interlocking profiles 18, 22. The upper closure bars urge the upper interlocking profiles 18, 22 together directly over the tail member 80, thereby preventing the tail member from moving between the upper interlocking profiles and slidably retaining the slider 16 on the closure mechanism 12. When the slider 16 is tracked along the closure mechanism 12 in an open direction as indicated in FIG. 1, the separator member 70 separates the upper interlocking profile 18, 22, and the lower interlocking profiles 26, 28 remain occluded. The user may then completely separate the closure mechanism 12 by pulling the backing member 20 apart from the backing member 24, thereby de-occluding the lower interlocking profile 26 from the lower interlocking profile 28.

INDUSTRIAL APPLICABILITY

The pouch closure mechanism and slider, described herein, may be used to store products. The closure mechanism and the slider provide a mechanism for sealing, opening, and resealing the pouch and may also minimize or even eliminate leakage around the separator member when in the fully closed position. Of course, the closure mechanism and slider may be used for sealing and resealing openings of almost any kind.

Each patent and other reference cited herein is incorporated herein by reference in the entirety thereof. Numerous modifications to the present invention will be apparent to those skilled in the art in view of the foregoing description. Accordingly, this description is to be construed as illustrative only and is presented for the purpose of enabling those skilled in the art to make and use the pouch, closure mechanism, and slider disclosed herein and to teach the best mode of carrying out the same. The exclusive rights to all modifications within the scope of the impending claims are reserved.

I claim:

1. A slider for operatively engaging a longitudinally elongate closure mechanism having opposing pairs of upper and lower interlocking profiles, the slider comprising:

a first sidewall opposing a second sidewall, the first and second sidewalls depending from a top wall and defining a channel therebetween for accepting the closure mechanism therein;

a first closure bar on the first sidewall proximate an opening end of the channel, the first closure bar vertically aligned with and adapted to close the lower interlocking profiles;

a second closure bar on the first sidewall longitudinally spaced from the first closure bar toward a closing end of the channel opposite the opening end, the second closure bar disposed to close the upper interlocking profiles; and a separator member extending into the channel from the top wall proximate the opening end and spaced between the first and second sidewalls, the separator member disposed to separate the upper interlocking profiles.

2. The slider of claim 1, wherein the separator member is at least partly longitudinally coextensive with the first closure bar.

3. The slider of claim 1 further comprising a retention member extending from the separator member, the retention member spaced between the first sidewall and the second sidewall and disposed above the first closure bar and below the second closure bar.

4. The slider of claim 3, wherein the retention member extends to the closing end of the channel.

5. The slider of claim 3, wherein a portion of the retention member is longitudinally coextensive with the second closure bar.

6. The slider of claim 1 further comprising a horizontal projection extending laterally from the separator member toward the first sidewall, the horizontal projection disposed vertically between the first closure bar and the second closure bar.

7. The slider of claim 6, wherein the horizontal projection extends longitudinally beyond the opening end of the channel.

8. The slider of claim 6, wherein the horizontal projection includes a hook member.

9. The slider of claim 6, wherein the horizontal projection includes a tapered nose.

10. The slider of claim 9, wherein the horizontal projection includes a tapered lower edge.

11. The slider of claim 1, wherein the separator member is disposed to separate only the upper interlocking profiles.

12. A closure mechanism, comprising:

a longitudinally elongate closure profile comprising:

a first interlocking member disposed on a first backing member and a second interlocking member disposed on the first backing member and spaced below the first interlocking member;

a third interlocking member disposed on a second backing member and a fourth interlocking member disposed on the second backing member and spaced below the third interlocking member; and an actuating member slidably disposed on the elongate closure profile and adapted to occlude and de-occlude at least the first interlocking member and the third interlocking member, the actuating member comprising:

a body defining a channel longitudinally extending between an opening end and a closing end opposite the opening end, the channel accepting the elongate closure profile therein;

a separator member extending into the channel between the first interlocking member and the third interlocking member;

a first retention member carried by the separator member and projecting laterally directly under a de-occluded portion of the first interlocking member and the third interlocking member;

a second retention member carried by the separator member and projecting toward the closing end directly under an occluded portion of the first interlocking member and the third interlocking member;

a first pair of opposing closing members aligned with the first interlocking member and the third interlocking member, wherein the first pair of opposing closing members urges the first interlocking member into interlocking relation with the third interlocking member therebetween, and the first pair of opposing closing members is disposed directly above a portion of the second retention member; and a second pair of opposing closing members aligned with the second interlocking member and the fourth interlocking member, wherein the second pair of opposing closing members urges the second interlocking member into interlocking relation with the fourth interlocking member therebetween;

wherein the separator member is disposed between the first pair of opposing closing members and an opening end of the second pair of opposing closing members.

13. The closure mechanism of claim 12, wherein the first pair of opposing closing members is spaced toward the closing end and above the second pair of opposing closing members, and wherein the second pair of opposing closing members is disposed near the opening end.

14. The closure mechanism of claim 13, wherein the first opposing pair of closing members comprises opposing first and second projections from opposing sidewalls of the actuating member arranged to squeeze the first interlocking member and the third interlocking member therebetween, and wherein the second opposing pair of closing members comprises opposing third and fourth projections from the opposing sidewalls of the actuating member arranged to squeeze the second interlocking member and the fourth interlocking member therebetween.

15. The closure mechanism of claim 14, wherein the second retention member comprises an elongate portion extending between the separator and the closing end, the elongate portion disposed between the first interlocking member and the second interlocking member.

16. The closure mechanism of claim 15, wherein the first retention member further comprises a wedged body portion disposed at a distal end of the separator member and a wedged end portion projecting beyond the separating member toward or beyond the opening end, and wherein a traction member is disposed on an outer side of the actuating member.

* * * * *